US011708618B2

(12) United States Patent
Ott

(10) Patent No.: US 11,708,618 B2
(45) **Date of Patent: *Jul. 25, 2023**

(54) CAST IRON INOCULANT AND METHOD FOR PRODUCTION OF CAST IRON INOCULANT

(71) Applicant: ELKEM ASA, Oslo (NO)

(72) Inventor: Emmanuelle Ott, Oslo (NO)

(73) Assignee: ELKEM ASA, Oslo (NO)

( * ) Notice: Subject to any disclaimer, the term of this patent is extended or adjusted under 35 U.S.C. 154(b) by 262 days.

This patent is subject to a terminal disclaimer.

(21) Appl. No.: 16/957,284

(22) PCT Filed: Dec. 21, 2018

(86) PCT No.: PCT/NO2018/050327

§ 371 (c)(1),
(2) Date: Jun. 23, 2020

(87) PCT Pub. No.: WO2019/132671

PCT Pub. Date: Jul. 4, 2019

(65) Prior Publication Data

US 2020/0399724 A1 Dec. 24, 2020

(30) Foreign Application Priority Data

Dec. 29, 2017 (NO) ..... 20172064

(51) Int. Cl.
*C21C 1/10* (2006.01)
*C22C 33/08* (2006.01)

(52) U.S. Cl.
CPC ..... *C21C 1/105* (2013.01); *C22C 33/08* (2013.01)

(58) Field of Classification Search
None
See application file for complete search history.

(56) References Cited

U.S. PATENT DOCUMENTS 4,432,793 A 2/1984 Hilaire et al.
5,733,502 A 3/1998 Margaria et al.
(Continued)

FOREIGN PATENT DOCUMENTS

CN 1281513 A 1/2001
CN 1687464 A 10/2005
(Continued)

OTHER PUBLICATIONS

Horie et al. "Effect of Bismuth on Nodule Count in Spheroidal Graphite Iron Castings with Thin Section." Castings, vol. 60, No. 3, Japan, 1988, pp. 173-178. (Year: 1988).*
(Continued)

*Primary Examiner* — Brian D Walck
(74) *Attorney, Agent, or Firm* — Lucas & Mercanti, LLP

(57) ABSTRACT

An inoculant for the manufacture of cast iron with spheroidal graphite is disclosed, the inoculant has a particulate ferrosilicon alloy having
between 40 and 80% by weight of Si,
0.02-8% by weight of Ca;
0-5% by weight of Sr;
0-12% by weight of Ba;
0-10% by weight of rare earth metal;
0-5% by weight of Mg;
0.05-5% by weight of Al;
0-10% by weight of Mn;
0-10% by weight of Ti;
0-10% by weight of Zr;
the balance being Fe and incidental impurities in the ordinary amount,
wherein the inoculant additionally contains, by weight, based on the total weight of inoculant: 0.1 to 15% by weight of particulate rare earth metal oxide(s) and
at least one of from 0.1 to 15% of particulate $Bi_2O_3$, and/or from 0.1 to 15% of particulate $Bi_2S_3$, and/or from 0.1 to
(Continued)

15% of particulate $Sb_2O_3$, and/or from 0.1 to 15% of particulate $Sb_2S_3$, and/or from 0.1 to 5% of one of more of particulate $Fe_3O_4$, $Fe_2O_3$, FeO, or a mixture thereof, and/or from 0.1 to 5% of one of more of particulate FeS, $FeS_2$, $Fe_3S_4$, or a mixture thereof, a method for producing such inoculant and use of such inoculant.

23 Claims, 4 Drawing Sheets

(56) References Cited

U.S. PATENT DOCUMENTS

| | | | | |
|---|---|---|---|---|
| 2015/0284830 | A1 | 10/2015 | Fay et al. | |
| 2016/0047008 | A1 | 2/2016 | Margaria et al. | |
| 2020/0340069 | A1* | 10/2020 | Ott | C21C 7/0075 |
| 2020/0399725 | A1* | 12/2020 | Knustad | C22C 33/08 |
| 2020/0399726 | A1* | 12/2020 | Ott | C22C 38/002 |

FOREIGN PATENT DOCUMENTS

| | | | |
|---|---|---|---|
| CN | 1833041 | A | 9/2006 |
| CN | 101525719 | A | 9/2009 |
| CN | 102002548 | A | 4/2011 |
| CN | 103484749 | A | 1/2014 |
| CN | 103898268 | B | 8/2015 |
| CN | 105401049 | A | 3/2016 |
| CN | 105950953 | A | 9/2016 |
| CN | 106755704 | A | 5/2017 |
| CN | 106834588 | A | 6/2017 |
| CN | 107354370 | A | 11/2017 |
| CN | 107400750 | A | 11/2017 |
| CN | 107829017 | A | 3/2018 |
| EP | 1126037 | A1 | 8/2001 |
| GB | 1296048 | A | 11/1972 |
| JP | S5591911 | A | 7/1980 |
| JP | S5943843 | A | 3/1984 |
| JP | S63282206 | A | 11/1988 |
| JP | H08120396 | A | 5/1996 |
| JP | 2005514207 | A | 5/2005 |
| RU | 2124566 | C1 | 1/1999 |
| SU | 872563 | A1 | 10/1981 |
| SU | 1047969 | A1 | 10/1983 |
| SU | 1186682 | A1 | 10/1985 |
| WO | 9524508 | A1 | 9/1995 |
| WO | 9929911 | A1 | 6/1999 |
| WO | 02081758 | A1 | 10/2002 |
| WO | 2006068487 | A1 | 6/2006 |
| WO | 2016186094 | A1 | 11/2016 |
| WO | 2018004356 | A1 | 1/2018 |

OTHER PUBLICATIONS

W. Wang, et al; Development of a new type of ductile iron inoculant; Thermal Processing Technologies; vol. 39, No. 23; Dec. 31, 2010; pp. 31-33.

Search Report for Corresponding Chinese Application No. 201880083897.5 dated Aug. 18, 2021; 3 Pages.

Search Report for Corresponding Norwegian Application No. 20172061 (2 Pages) (dated Jul. 20, 2018).

International Search Report and Written Opinion for Corresponding International Application No. PCT/NO2018/050324 (11 Pages) (dated Apr. 4, 2019).

International Search Report and Written Opinion for Corresponding International Application No. PCT/NO2018/050327 (10 Pages) (dated Apr. 17, 2019).

Search Report for Corresponding Norwegian Application No. 20172064(2 Pages) (dated Jul. 20, 2018).

Search Report for Corresponding Taiwanese Application No. 107147351 (1 Page) (dated Oct. 15, 2019).

International Preliminary Report on Patentability for Corresponding International Application No. PCT/NO2018/050327 (16 Pages) (dated Dec. 4, 2019).

International Search Report and Written Opinion for Corresponding International Application No. PCT/NO2018/050325 (9 Pages) (dated Apr. 15, 2019).

Search Report for Corresponding Norwegian Application No. 20172062 (2 Pages) (dated Jul. 20, 2018).

Search Report for Corresponding Taiwanese Application No. 107147349 (1 Page) ( dated Aug. 1, 2019).

International Search Report and Written Opinion for Corresponding International Application No. PCT/NO2018/050326 (10 Pages) (dated Apr. 26, 2019).

Search Report for Corresponding Norwegian Application No. 20172063 (2 Pages) (dated Jul. 20, 2018).

Search Report for Corresponding Taiwanese Application No. 107147350 (1Page) (dated Oct. 15, 2019).

Search Report for Corresponding Norwegian Application No. 20172065 (2 Pages) (dated Jul. 20, 2018).

Search Report for Corresponding Taiwanese Application No. 107147348 (1 Page) (dated Oct. 15, 2019).

International Search Report and Written Opinion for Corresponding International Application No. PCT/NO2018/050328 (10 Pages) (dated Apr. 26, 2019).

Search Report for Corresponding Russian Application No. 2020124952 dated Jul. 6, 2021; 2 Pages.

Search Report for Corresponding Brazilian Patent Application No. BR112020012707-8, 4 pages, dated Jul. 5, 2022.

* cited by examiner

CAST IRON INOCULANT AND METHOD FOR PRODUCTION OF CAST IRON INOCULANT

CROSS REFERENCE TO RELATED APPLICATION

This Application is a 371 of PCT/N02018/050327 filed on Dec. 21, 2018 which, in turn, claimed the priority of Norwegian Patent Application No. 20172064 filed on Dec. 29, 2017, both applications are incorporated herein by reference.

TECHNICAL FIELD

The present invention relates to a ferrosilicon based inoculant for the manufacture of cast iron with spheroidal graphite and to a method for production of the inoculant.

BACKGROUND ART

Cast iron is typically produced in cupola or induction furnaces, and generally contain between 2 to 4 percent carbon. The carbon is intimately mixed with the iron and the form which the carbon takes in the solidified cast iron is very important to the characteristics and properties of the iron castings. If the carbon takes the form of iron carbide, then the cast iron is referred to as white cast iron and has the physical characteristics of being hard and brittle, which in most applications is undesirable. If the carbon takes the form of graphite, the cast iron is soft and machinable.

Graphite may occur in cast iron in the lamellar, compacted or spheroidal forms. The spheroidal shape produces the highest strength and most ductile type of cast iron.

The form that the graphite takes as well as the amount of graphite versus iron carbide, can be controlled with certain additives that promote the formation of graphite during the solidification of cast iron. These additives are referred to as nodularisers and inoculants and their addition to the cast iron as nodularisation and inoculation, respectively. In cast iron production formation iron carbide especially in thin sections are often a challenge. The formation of iron carbide is brought about by the rapid cooling of the thin sections as compared to the slower cooling of the thicker sections of the casting. The formation of iron carbide in a cast iron product is referred to in the trade as "chill". The formation of chill is quantified by measuring "chill depth" and the power of an inoculant to prevent chili and reduce chill depth is a convenient way in which to measure and compare the power of inoculants, especially in grey irons. In nodular iron, the power of inoculants is usually measured and compared using the graphite nodule number density.

As the industry develops there is a need for stronger materials. This means more alloying with carbide promoting elements such as Cr, Mn, V, Mo, etc., and thinner casting sections and lighter design of castings. There is therefore a constant need to develop inoculants that reduce chill depth and improve machinability of grey cast irons as well as increase the number density of graphite spheroids in ductile cast irons. The exact chemistry and mechanism of inoculation and why inoculants function as they do in different cast iron melts is not completely understood, therefore a great deal of research goes into providing the industry with new and improved inoculants.

It is thought that calcium and certain other elements suppress the formation of iron carbide and promote the formation of graphite. A majority of inoculants contain calcium. The addition of these iron carbide suppressants is usually facilitated by the addition of a ferrosilicon alloy and probably the most widely used ferrosilicon alloys are the high silicon alloys containing 70 to 80% silicon and the low silicon alloy containing 45 to 55% silicon. Elements which commonly may be present in inoculants, and added to the cast iron as a ferrosilicon alloy to stimulate the nucleation of graphite in cast iron, are e.g. Ca, Ba, Sr, Al, rare earth metals (RE), Mg, Mn, Bi, Sb, Zr and Ti.

The suppression of carbide formation is associated by the nucleating properties of the inoculant. By nucleating properties it is understood the number of nuclei formed by an inoculant. A high number of nuclei formed results in an increased graphite nodule number density and thus improves the inoculation effectiveness and improves the carbide suppression. Further, a high nucleation rate may also give better resistance to fading of the inoculating effect during prolonged holding time of the molten iron after inoculation. Fading of inoculation can be explained by the coalescing and re-solution of the nuclei population which causes the total number of potential nucleation sites to be reduced.

U.S. Pat. No. 4,432,793 discloses an inoculant containing bismuth, lead and/or antimony. Bismuth, lead and/or antimony are known to have high inoculating power and to provide an increase in the number of nuclei. These elements are also known to be anti-spheroidizing elements, and the increasing presence of these elements in cast iron is known to cause degeneration of the spheroidal graphite structure of graphite. The inoculant according to U.S. Pat. No. 4,432,793 is a ferrosilicon alloy containing from 0.005% to 3% rare earths and from 0.005% to 3% of one of the metallic elements bismuth, lead and/or antimony alloyed in the ferrosilicon.

According to U.S. Pat. No. 5,733,502 the inoculants according to the said U.S. Pat. No. 4,432,793 always contain some calcium which improves the bismuth, lead and/or antimony yield at the time the alloy is produced and helping to distribute these elements homogeneously within the alloy, as these elements exhibit poor solubility in the iron-silicon phases. However, during storage the product tends to disintegrate and the granulometry tends toward an increased amount of fines. The reduction of granulometry was linked to the disintegration, caused by atmospheric moisture, of a calcium-bismuth phase collected at the grain boundaries of the inoculants. In U.S. Pat. No. 5,733,502 it was found that the binary bismuth-magnesium phases, as well as the ternary bismuth-magnesium-calcium phases, were not attacked by water. This result was only achieved for high silicon ferrosilicon alloy inoculants, for low silicon FeSi inoculants the product disintegrated during storage. The ferrosilicon-based alloy for inoculation according to U.S. Pat. No. 5,733,502 thus contains (by weight %) from 0.005-3% rare earths, 0.005-3% bismuth, lead and/or antimony, 0.3-3% calcium and 0.3-3% magnesium, wherein the Si/Fe ratio is greater than 2.

U.S. patent application No. 2015/0284830 relates to an inoculant alloy for treating thick cast-iron parts, containing between 0.005 and 3 wt % of rare earths and between 0.2 and 2 wt % Sb. Said US 2015/0284830 discovered that antimony, when allied to rare earths in a ferrosilicon-based alloy, would allow an effective inoculation, and with the spheroids stabilized, of thick parts without the drawbacks of pure antimony addition to the liquid cast-iron. The inoculant according to US 2015/0284830 is described to be typically used in the context of an inoculation of a cast-iron bath, for pre-conditioning said cast-iron as well as a nodularizer treatment. An inoculant according to US 2015/0284830 contains (by wt %) 65% Si, 1.76% Ca, 1.23% Al, 0.15% Sb, 0.16% RE, 7.9% Ba and balance iron.

From WO 95/24508 it is known a cast iron inoculant showing an increased nucleation rate. This inoculant is a ferrosilicon based inoculant containing calcium and/or strontium and/or barium, less than 4% aluminium and between 0.5 and 10% oxygen in the form of one or more metal oxides. It was, however found that the reproducibility of the number of nuclei formed using the inoculant according to WO 95/24508 was rather low. In some instances a high number of nuclei are formed in the cast iron, but in other instances the numbers of nuclei formed are rather low. The inoculant according to WO 95/24508 has for the above reason found little use in practice.

From WO 99/29911 it is known that the addition of sulphur to the inoculant of WO 95/24508 has a positive effect in the inoculation of cast iron and increases the reproducibility of nuclei.

In WO 95/24508 and WO 99/29911 iron oxides; FeO, $Fe_2O_3$ and $Fe_3O_4$, are the preferred metal oxides. Other metal oxides mentioned in these patent applications are $SiO_2$, MnO, MgO, CaO, $Al_2O_3$, $TiO_2$ and $CaSiO_3$, $CeO_2$, $ZrO_2$. The preferred metal sulphide is selected from the group consisting of FeS, $FeS_2$, MnS, MgS, CaS and CuS.

From US application No. 2016/0047008 it is known a particulate inoculant for treating liquid cast-iron, comprising, on the one hand, support particles made of a fusible material in the liquid cast-iron, and on the other hand, surface particles made of a material that promotes the germination and the growth of graphite, disposed and distributed in a discontinuous manner at the surface of the support particles, the surface particles presenting a grain size distribution such that their diameter d50 is smaller than or equal to one-tenth of the diameter d50 of the support particles. The purpose of the inoculant in said US 2016' is inter alia indicated for the inoculation of cast-iron parts with different thicknesses and low sensibility to the basic composition of the cast-iron.

Thus, there is a desire to provide an inoculant having improved nucleating properties and forming a high number of nuclei, which results in an increased graphite nodule number density and thus improves the inoculation effectiveness. Another desire is to provide a high performance inoculant. A further desire is to provide an inoculant which may give better resistance to fading of the inoculating effect during prolonged holding time of the molten iron after inoculation. At least some of the above desires are met with the present invention, as well as other advantages, which will become evident in the following description.

SUMMARY OF INVENTION

The prior art inoculant according to WO 99/29911 is considered to be a high performance inoculant, which gives a high number of nodules in ductile cast iron. It has now been found that the addition of rare earth metal oxide(s) combined with at least one of bismuth oxide, bismuth sulphide, antimony oxide, antimony sulphide, iron oxide and/or iron sulphide to the inoculant of WO 99/29911 surprisingly results in a significantly higher number of nuclei, or nodule number density, in cast irons when adding the inoculant according to the present invention to cast iron.

In a first aspect, the present invention relates to an inoculant for the manufacture of cast iron with spheroidal graphite, where said inoculant comprises a particulate ferrosilicon alloy consisting of between 40 and 80% by weight of Si; 0.02-8% by weight of Ca; 0-5% by weight of Sr; 0-12% by weight of Ba; 0-10% by weight of rare earth metal; 0-5% by weight of Mg; 0.05-5% by weight of Al; 0-10% by weight of Mn; 0-10% by weight of Ti; 0-10% by weight of Zr; the balance being Fe and incidental impurities in the ordinary amount, and where said inoculant additionally contains, by weight, based on the total weight of inoculant: 0.1 to 15% by weight of particulate rare earth metal oxide(s) and at least one of from 0.1 to 15% of particulate $Bi_2O_3$, and/or from 0.1 to 15% of particulate $Bi_2S_3$, and/or from 0.1 to 15% of particulate $Sb_2O_3$, and/or from 0.1 to 15% of particulate $Sb_2S_3$, and/or from 0.1 to 5% of one or more of particulate $Fe_3O_4$, $Fe_2O_3$, FeO, or a mixture thereof, and/or from 0.1 to 5% of one or more of particulate FeS, $FeS_2$, $Fe_3S_4$, or a mixture thereof.

In an embodiment, the ferrosilicon alloy comprises between 45 and 60% by weight of Si. In another embodiment of the inoculant the ferrosilicon alloy comprises between 60 and 80% by weight of Si.

In an embodiment, the rare earth metals in the ferrosilicon alloy include Ce, La, Y and/or mischmetal. In an embodiment, the ferrosilicon alloy comprises up to 6% by weight of rare earth metal.

In an embodiment, the ferrosilicon alloy comprises between 0.5 and 3% by weight of Ca. In an embodiment, the ferrosilicon alloy comprises between 0 and 3% by weight of Sr. In a further embodiment, the ferrosilicon alloy comprises between 0.2 and 3% by weight of Sr. In an embodiment, the ferrosilicon alloy comprises between 0 and 5% by weight of Ba. In a further embodiment, the ferrosilicon alloy comprises between 0.1 and 5% by weight of Ba. In an embodiment, the ferrosilicon alloy comprises between 0.5 and 5% by weight Al. In an embodiment, the ferrosilicon alloy comprises up to 6% by weight of Mn and/or Ti and/or Zr. In an embodiment, the ferrosilicon alloy comprises less than 1% by weight Mg.

In an embodiment the inoculant comprises 0.2 to 12% by weight of particulate rare earth metal oxide(s). In an embodiment the rare earth metal oxide(s) is (are) one or more of $CeO_2$ and/or $La_2O_3$ and/or $Y_2O_3$.

In an embodiment, the inoculant comprises, in addition to the said particulate rare earth metal oxide(s); at least one of particulate $Bi_2O_3$, and/or particulate $Bi_2S_3$, and/or particulate $Sb_2O_3$, and/or particulate $Sb_2S_3$, and optionally one or more of particulate $Fe_3O_4$, $Fe_2O_3$, FeO, or a mixture thereof, and/or one or more of particulate FeS, $FeS_2$, $Fe_3S_4$, or a mixture thereof.

In an embodiment, the inoculant comprises between 0.3 and 10% by weight of particulate $Bi_2S_3$.

In an embodiment, the inoculant comprises between 0.3 and 10% of particulate $Bi_2O_3$.

In an embodiment, the inoculant comprises between 0.3 and 10% of particulate $Sb_2O_3$.

In an embodiment, the inoculant comprises between 0.3 and 10% of particulate $Sb_2S_3$.

In an embodiment, the inoculant comprises between 0.5 and 3% of one or more of particulate $Fe_3O_4$, $Fe_2O_3$, FeO, or a mixture thereof, and/or between 0.5 and 3% of one or more of particulate FeS, $FeS_2$, $Fe_3S_4$, or a mixture thereof.

In an embodiment, the total amount (sum of sulphide/oxide compounds) of the particulate rare earth metal oxide(s), and at least one of particulate $Bi_2O_3$, and/or particulate $Bi_2S_3$, and/or particulate $Sb_2O_3$, and/or particulate $Sb_2S_3$, and/or one or more of particulate $Fe_3O_4$, and/or one or more of particulate FeS, $FeS_2$, $Fe_3S_4$, or a mixture thereof, is up to 20% by weight, based on the total weight of the inoculant. In another embodiment the total amount of particulate rare earth metal oxide(s), and at least one of particulate $Bi_2O_3$, and/or particulate $Bi_2S_3$, and/or particulate $Sb_2O_3$, and/or particulate $Sb_2S_3$, and/or one or more of particulate $Fe_3O_4$, $Fe_2O_3$, FeO, or a mixture thereof, and/or one or more of particulate FeS, $FeS_2$, $Fe_3S_4$, or a mixture thereof, is up to 15% by weight, based on the total weight of the inoculant.

In an embodiment, the inoculant is in the form of a blend or a mechanical/physical mixture of the particulate ferrosilicon alloy and the particulate rare earth metal oxide(s), and at least one of particulate $Bi_2O_3$, and/or particulate $Bi_2S_3$, and/or particulate $Sb_2O_3$, and/or particulate $Sb_2S_3$, and/or one or more of particulate $Fe_3O_4$, $Fe_2O_3$, FeO, or a mixture thereof, and/or one or more of particulate FeS, $FeS_2$, $Fe_3S_4$, or a mixture thereof.

In an embodiment, the particulate rare earth metal oxide(s), and at least one of particulate $Bi_2O_3$, and/or particulate $Bi_2S_3$, and/or particulate $Sb_2O_3$, and/or particulate $Sb_2S_3$, and/or one or more of particulate $Fe_3O_4$, $Fe_2O_3$, FeO, or a mixture thereof, and/or one or more of particulate FeS, $FeS_2$, $Fe_3S_4$, or a mixture thereof, are present as coating compounds on the particulate ferrosilicon based alloy.

In an embodiment, the particulate rare earth metal oxide(s), and at least one of particulate $Bi_2O_3$, and/or particulate $Bi_2S_3$, and/or particulate $Sb_2O_3$, and/or particulate $Sb_2S_3$, and/or one or more of particulate $Fe_3O_4$, $Fe_2O_3$, FeO, or a mixture thereof, and/or one or more of particulate FeS, $FeS_2$, $Fe_3S_4$, or a mixture thereof, are mechanically mixed or blended with the particulate ferrosilicon based alloy, in the presence of a binder.

In an embodiment, the inoculant is in the form of agglomerates made from a mixture of the particulate ferrosilicon alloy and the particulate rare earth metal oxide(s), and at least one of particulate $Bi_2O_3$, and/or particulate $Bi_2S_3$, and/or particulate $Sb_2O_3$, and/or particulate $Sb_2S_3$, and/or one or more of particulate $Fe_3O_4$, $Fe_2O_3$, FeO, or a mixture thereof, and/or one or more of particulate FeS, $FeS_2$, $Fe_3S_4$, or a mixture thereof, in the presence of a binder.

In an embodiment, the inoculant is in the form of briquettes made from a mixture of the particulate ferrosilicon alloy and the particulate rare earth metal oxide(s), and at least one of particulate $Bi_2O_3$, and/or particulate $Bi_2S_3$, and/or particulate $Sb_2O_3$, and/or particulate $Sb_2S_3$, and/or one or more of particulate $Fe_3O_4$, $Fe_2O_3$, FeO, or a mixture thereof, and/or one or more of particulate FeS, $FeS_2$, $Fe_3S_4$, or a mixture thereof, in the presence of a binder.

In an embodiment, the particulate ferrosilicon based alloy and the particulate rare earth metal oxide(s), and at least one of particulate $Bi_2O_3$, and/or particulate $Bi_2S_3$, and/or particulate $Sb_2O_3$, and/or particulate $Sb_2S_3$, and/or one or more of particulate $Fe_3O_4$, $Fe_2O_3$, FeO, or a mixture thereof, and/or one or more of particulate FeS, $FeS_2$, $Fe_3S_4$, or a mixture thereof, are added separately but simultaneously to liquid cast iron.

In a second aspect the present invention relates to a method for producing an inoculant according to the present invention, the method comprises: providing a particulate base alloy comprising between 40 and 80% by weight of Si, 0.02-8% by weight of Ca; 0-5% by weight of Sr; 0-12% by weight of Ba; 0-10% by weight of rare earth metal; 0-5% by weight of Mg; 0.05-5% by weight of Al; 0-10% by weight of Mn; 0-10% by weight of Ti; 0-10% by weight of Zr; the balance being Fe and incidental impurities in the ordinary amount, and adding to the said particulate base, by weight, based on the total weight of inoculant: 0.1 to 15% by weight of particulate rare earth metal oxide(s) and at least one of from 0.1 to 15% of particulate $Bi_2O_3$, and/or from 0.1 to 15% of particulate $Bi_2S_3$, and/or from 0.1 to 15% of particulate $Sb_2O_3$, and/or from 0.1 to 15% of particulate $Sb_2S_3$, and/or from 0.1 to 5% of one or more of particulate $Fe_3O_4$, $Fe_2O_3$, FeO, or a mixture thereof, and/or from 0.1 to 5% of one or more of particulate FeS, $FeS_2$, $Fe_3S_4$, or a mixture thereof, to produce said inoculant.

In an embodiment of the method the particulate rare earth metal oxide(s), and at least one of particulate $Bi_2O_3$, and/or particulate $Bi_2S_3$, and/or particulate $Sb_2O_3$, and/or particulate $Sb_2S_3$, and/or one or more of particulate $Fe_3O_4$, $Fe_2O_3$, FeO, or a mixture thereof, and/or one or more of particulate FeS, $FeS_2$, $Fe_3S_4$, or a mixture thereof, are mechanically mixed or blended with the particulate base alloy.

In an embodiment of the method the particulate rare earth metal oxide(s), and at least one of particulate $Bi_2O_3$, and/or particulate $Bi_2S_3$, and/or particulate $Sb_2O_3$, and/or particulate $Sb_2S_3$, and/or one or more of particulate $Fe_3O_4$, $Fe_2O_3$, FeO, or a mixture thereof, and/or one or more of particulate FeS, $FeS_2$, $Fe_3S_4$, or a mixture thereof, are mechanically mixed before being mixed with the particulate base alloy.

In an embodiment of the method the particulate rare earth metal oxide(s), and at least one of particulate $Bi_2O_3$, and/or particulate $Bi_2S_3$, and/or particulate $Sb_2O_3$, and/or particulate $Sb_2S_3$, and/or one or more of particulate $Fe_3O_4$, $Fe_2O_3$, FeO, or a mixture thereof, and/or one or more of particulate FeS, $FeS_2$, $Fe_3S_4$, or a mixture thereof, are mechanically mixed or blended with the particulate base alloy in the presence of a binder. In a further embodiment of the method, the mechanically mixed or blended particulate base alloy, the particulate rare earth metal oxide(s), and at least one of particulate $Bi_2O_3$, and/or particulate $Bi_2S_3$, and/or particulate $Sb_2O_3$, and/or particulate $Sb_2S_3$, and/or one or more of particulate $Fe_3O_4$, $Fe_2O_3$, FeO, or a mixture thereof, and/or one or more of particulate FeS, $FeS_2$, $Fe_3S_4$, or a mixture thereof, in the presence of a binder, are further formed into agglomerates or briquettes.

In another aspect, the present invention related to the use of the inoculant as defined above in the manufacturing of cast iron with spheroidal graphite, by adding the inoculant to the cast iron melt prior to casting, simultaneously to casting or as an in-mould inoculant.

In an embodiment of the use of the inoculant the particulate ferrosilicon based alloy and the particulate rare earth metal oxide(s), and at least one of particulate $Bi_2O_3$, and/or particulate $Bi_2S_3$, and/or particulate $Sb_2O_3$, and/or particulate $Sb_2S_3$, and/or one or more of particulate $Fe_3O_4$, $Fe_2O_3$, FeO, or a mixture thereof, and/or one or more of particulate FeS, $FeS_2$, $Fe_3S_4$, or a mixture thereof, are added as a mechanical/physical mixture or a blend to the cast iron melt.

In an embodiment of the use of the inoculant the particulate ferrosilicon based alloy and the particulate rare earth metal oxide(s), and at least one of particulate $Bi_2O_3$, and/or particulate $Bi_2S_3$, and/or particulate $Sb_2O_3$, and/or particulate $Sb_2S_3$, and/or one or more of particulate $Fe_3O_4$, $Fe_2O_3$, FeO, or a mixture thereof, and/or one or more of particulate FeS, $FeS_2$, $Fe_3S_4$, or a mixture thereof, are added separately but simultaneously to the cast iron melt.

In any of the above embodiments, the inoculant may comprise, in addition to the said particulate rare earth metal oxide(s); at least one of particulate $Bi_2O_3$, and/or particulate $Bi_2S_3$, and/or particulate $Sb_2O_3$, and/or particulate $Sb_2S_3$, and optionally one or more of particulate $Fe_3O_4$, and/or one or more of particulate FeS, $FeS_2$, $Fe_3S_4$, or a mixture thereof.

DETAILED DESCRIPTION OF THE INVENTION

Figure 1:
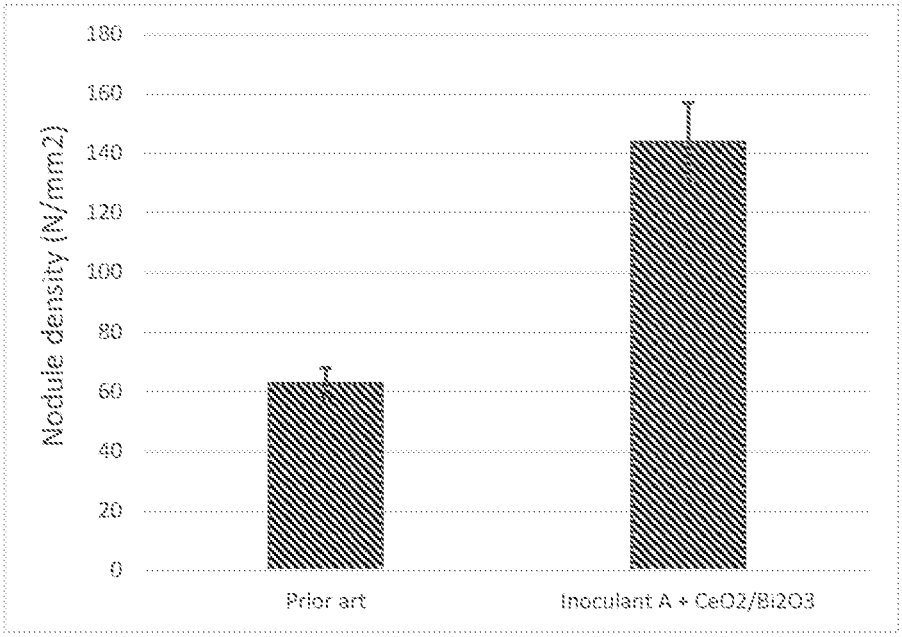
FIG. 1: diagram showing nodule number density (nodule number per $mm^2$, abbreviated $N/mm^2$) in cast iron samples of Melt P in example 1.

According to the present invention a high potent inoculant is provided, for the manufacture of cast iron with spheroidal graphite. The inoculant comprises a FeSi base alloy particles combined with particulate rare earth metal oxide(s) and also comprises at least one of particulate bismuth oxide ($Bi_2O_3$), and/or bismuth sulphide ($B_2S_3$), and/or antimony oxide ($Sb_2O_3$), and/or antimony sulphide ($Sb_2S_3$), and/or iron oxide (one or more of $Fe_3O_4$, $Fe_2O_3$, FeO, or a mixture thereof) and/or iron sulphide (one or more of FeS, $FeS_2$, $Fe_3S_4$, or a mixture thereof). The inoculant according to the present invention is easy to manufacture and it is easy to control and vary the amounts of RE, Bi and or Sb in the inoculant. Complicated and costly alloying steps are avoided, thus the inoculant can be manufactured at a lower cost compared to prior art inoculants containing rare earth metals, Bi and/or Sb.

In the manufacturing process for producing ductile cast iron with compacted or spheroidal graphite the cast iron melt is normally treated with a nodulariser, e.g. by using an MgFeSi alloy, prior to the inoculation treatment. The nodularisation treatment has the objective to change the form of the graphite from flake to nodule when it is precipitating and subsequently growing. The way this is done is by changing the interface energy of the interface graphite/melt. It is known that Mg and Ce are elements that change the interface energy, Mg being more effective than Ce. When Mg is added to a base iron melt, it will first react with oxygen and sulphur, and it is only the "free magnesium" that will have a nodularising effect. The nodularisation reaction is violent and results in agitation of the melt, and it generates slag floating on the surface. The violence of the reaction will result in most of the nucleation sites for graphite that were already in the melt (introduced by the raw materials) and other inclusions being part of the slag on the top and removed. However some MgO and MgS inclusions produced during the nodularisation treatment will still be in the melt. These inclusions are not good nucleation sites as such.

The primary function of inoculation is to prevent carbide formation by introducing nucleation sites for graphite. In addition to introducing nucleation sites the inoculation also transform the MgO and MgS inclusions formed during the nodularisation treatment into nucleation sites by adding a layer (with Ca, Ba or Sr) on the inclusions.

In accordance with the present invention, the particulate FeSi base alloys should comprise from 40 to 80% by weight Si. A pure FeSi alloy is a week inoculant, but is a common alloy carrier for active elements, allowing good dispersion in the melt. Thus, there exists a variety of known FeSi alloy compositions for inoculants. Conventional alloying elements in a FeSi alloy inoculant include Ca, Ba, Sr, Al, Mg, Zr, Mn, Ti and RE (especially Ce and La). The amount of the alloying elements may vary. Normally, inoculants are designed to serve different requirements in grey, compacted and ductile iron production. The inoculant according to the present invention may comprise a FeSi base alloy with a silicon content of about 40-80% by weight. The alloying elements may comprise about 0.02-8% by weight of Ca; about 0-5% by weight of Sr; about 0-12% by weight of Ba; about 0-10% by weight of rare earth metal; about 0-5% by weight of Mg; about 0.05-5% by weight of Al; about 0-10% by weight of Mn; about 0-10% by weight of Ti; about 0-10% by weight of Zr; and the balance being Fe and incidental impurities in the ordinary amount.

The FeSi base alloy may be a high silicon alloy containing 60 to 80% silicon or a low silicon alloy containing 45 to 60% silicon. Silicon is normally present in cast iron alloys, and is a graphite stabilizing element in the cast iron, which forces carbon out of the solution and promotes the formation of graphite. The FeSi base alloy should have a particle size lying within the conventional range for inoculants, e.g. between 0.2 to 6 mm. It should be noted that smaller particle sizes, such as fines, of the FeSi alloy may also be applied in the present invention, to manufacture the inoculant. When using very small particles of the FeSi base alloy the inoculant may be in the form of agglomerates (e.g. granules) or briquettes. In order to prepare agglomerates and/or briquettes of the present inoculant, the rare earth metal oxide(s) and the at least one of $Bi_2O_3$, and/or $Bi_2S_3$, and/or $Sb_2O_3$, and/or $Sb_2S_3$, and/or iron oxide (one or more of $Fe_3O_4$, $Fe_2O_3$, FeO, or a mixture thereof) and/or iron sulphide (one or more of FeS, $FeS_2$, $Fe_3S_4$, or a mixture thereof), are mixed with the particulate ferrosilicon alloy by mechanical mixing or blending, in the presence of a binder, followed by agglomeration of the powder mixture according to the known methods. The binder may e.g. be a sodium silicate solution. The agglomerates may be granules with suitable product sizes, or may be crushed and screened to the required final product sizing.

A variety of different inclusions (sulphides, oxides, nitrides and silicates) can form in the liquid state. The sulphides and oxides of the group IIA-elements (Mg, Ca, Sr and Ba) have very similar crystalline phases and high melting points. The group IIA elements are known to form stable oxides in liquid iron; therefore inoculants, and nodularisers, based on these elements are known to be effective deoxidizers. Calcium is the most common trace element in ferrosilicon inoculants. In accordance with the invention, the particulate FeSi based alloy comprises between about 0.02 to about 8% by weight of calcium. In some applications it is desired to have low content of Ca in the FeSi base alloy, e.g. from 0.02 to 0.5% by weight. Compared to conventional inoculant ferrosilicon alloys containing alloyed bismuth, where calcium is regarded as a necessary element to improve the bismuth (and antimony) yield, there is no need for calcium for solubility purposes in the inoculants according to the present invention. In other applications the Ca content could be higher, e.g. from 0.5 to 8% by weight. A high level of Ca may increase slag formation, which is normally not desired. A plurality of inoculants comprise about 0.5 to 3% by weight of Ca in the FeSi alloy. The FeSi base alloy should comprise up to about 5% by weight of strontium. A Sr amount of 0.2-3% by weight is typically suitable. Barium may be present in an amount up to about 12% by weight in the FeSi inoculant alloy. Ba is known to give better resistance to fading of the inoculating effect during prolonged holding time of the molten iron after inoculation, and gives better efficiencies over a wider temperature range. Many FeSi alloy inoculants comprise about 0.1-5% by weight of Ba. If barium is used in conjunction with calcium the two may act together to give a greater reduction in chill than an equivalent amount of calcium.

Magnesium may be present in an amount up to about 5% by weight in the FeSi inoculant alloy. However, as Mg normally is added in the nodularisation treatment for the production of ductile iron, the amount of Mg in the inoculant may be low, e.g. up to about 0.1% by weight. Compared to conventional inoculant ferrosilicon alloys containing alloyed bismuth, where magnesium is regarded as a necessary element to stabilise the bismuth containing phases, there is no need for magnesium for stabilisation purposes in the inoculants according to the present invention.

The FeSi base alloy may comprise up to 10% by weight of rare earths metals (RE). RE includes at least Ce, La, Y and/or mischmetal. Mischmetal is an alloy of rare-earth elements, typically comprising approx. 50 Ce and 25% La, with small amounts of Nd and Pr. Lately heavier rare earth metals are often removed from the mischmetal, and the alloy composition of mischmetal may be about 65% Ce and about 35% La, and traces of heavier RE metals, such as Nd and Pr. Additions of RE are frequently used to restore the graphite nodule count and nodularity in ductile iron containing subversive elements, such as Sb, Pb, Bi, Ti etc. In some inoculants the amount of RE is up to 10% by weight. Excessive RE may in some instances lead to chunky graphite formations. Thus, in some applications the amount of RE should be lower, e.g. between 0.1-3% by weight. The inoculant according to the present invention contains RE oxide(s) as an additive to the particulate base ferrosilicon alloy, therefore the ferrosilicon alloy does not need any alloyed RE. Preferably the RE is Ce and/or La.

Aluminium has been reported to have a strong effect as a chill reducer. Al is often combined with Ca in a FeSi alloy inoculants for the production of ductile iron. In the present invention, the Al content should be up to about 5% by weight, e.g. from 0.1-5%.

Zirconium, manganese and/or titanium are also often present in inoculants. Similar as for the above mentioned elements, the Zr, Mn and Ti play an important role in the nucleation process of the graphite, which is assumed to be formed as a result of heterogeneous nucleation events during solidification. The amount of Zr in the FeSi base alloy may be up to about 10% by weight, e.g. up to 6% by weight. The amount of Mn in the FeSi base alloy may be up to about 10% by weight, e.g. up to 6% by weight. The amount of Ti in the FeSi base alloy may also be up to about 10% by weight, e.g. up to 6% by weight.

Bismuth and antimony are known to have high inoculating power and to provide an increase in the number of nuclei. However, the presence of small amounts of elements like Sb and/or Bi in the melt (also called subversive elements) might reduce nodularity. This negative effect can be neutralized by using Ce or other RE metal.

Introducing RE-oxide/$Sb_2O_3$/$Sb_2S_3$/$Bi_2O_3$/$Bi_2S_3$ together with the FeSi based alloy inoculant is adding a reactant to an already existing system with Mg inclusions floating around in the melt and "free" Mg. The addition of inoculant is not a violent reaction and the RE yield, the Sb yield, if Sb oxide and/or sulphide, is (are) added ($Sb/Sb_2O_3/Sb_2S_3$ remaining in the melt) and Bi yield, if Bi oxide and/or sulphide, is (are) added ($Bi/Bi_2O_3/Bi_2S_3$) remaining in the melt is expected to be high.

The amount of rare earth metal oxide(s) should be from 0.1 to 15% by weight based on the total amount of the inoculant. In some embodiments, the amount of rare earth metal oxide(s) should be from 0.2 to 12% by weight. In some embodiments, the amount of rare earth metal oxide(s) should be from 0.5 to 10% by weight. The RE-oxide particles should have a small particle size, i.e. micron size (e.g. 1-50 μm, or e.g. 1-10 μm). The rare earth metal oxide(s) is (are) one or more of $CeO_2$ and/or $La_2O_3$ and/or $Y_2O_3$. The rare earth metal oxide may also include oxides of Nd and/or Pr and other rare earth metals. The inoculant may comprise a mixture of the said rare earth metal oxides. Adding RE as one of more RE oxide combined with a FeSi base alloy is advantageous in several ways; in addition to giving a high number of nodules in cast samples, the present inoculants has an advantage that a ferrosilicon base alloy may be adapted for different uses by varying the amount of RE oxide, and other active inoculant elements (Bi, Sb oxide/sulphide) in a simple manner, thereby costly alloying steps are avoided; and it is possible to produce specific inoculant compositions in small volumes. It is also thought that RE oxide(s) will melt and/or dissolve faster than intermetallic phases, which are generally coarser in a ferrosilicon alloy.

The $Sb_2S_3$ particles, the $Sb_2O_3$ particles, the $Bi_2S_3$ particles and the $Bi_2O_3$ particles should have a small particle size, i.e. micron size, which result in very quick melting or dissolution of said particles when introduced into the cast iron melt. Advantageously, said RE-oxide particles, and the at least one of Bi and/or Sb and/or Fe oxide/sulphide particles are mixed with the particulate FeSi base alloy, prior to adding the inoculant into the cast iron melt.

The amount of particulate $Bi_2O_3$, if present, should be from 0.1 to 15% by weight based on the total amount of the inoculant. In some embodiments the amount of $Bi_2O_3$ can be 0.1-10% by weight. The amount of $Bi_2O_3$ can also be from about 0.5 to about 3.5% by weight, based on the total weight of inoculant.

The amount of particulate $Bi_2S_3$, if present, should be from 0.1 to 15% by weight based on the total amount of the inoculant. In some embodiments, the amount of $Bi_2S_3$ can be 0.1-10% by weight. The amount of $Bi_2S_3$ can also be about 0.5 to about 3.5% by weight, based on the total weight of inoculant. The particle size of $Bi_2O_3$ and $Bi_2S_3$ is typically 1-10 μm.

Adding Bi in the form of $Bi_2S_3$ and $Bi_2O_3$ particles, if present, instead of alloying Bi with the FeSi alloy has several advantages. Bi has poor solubility in ferrosilicon alloys, therefore, the yield of added Bi metal to the molten ferrosilicon is low and thereby the cost of a Bi-containing FeSi alloy inoculant increases. Further, due to the high density of elemental Bi it may be difficult to obtain a homogeneous alloy during casting and solidification. Another difficulty is the volatile nature of Bi metal due to the low melting temperature compared to the other elements in the FeSi based inoculant. Adding Bi as an oxide, if present, together with the FeSi base alloy provides an inoculant which is easy to produce with probably lower production costs compared to the traditional alloying process, wherein the amount of Bi is easily controlled and reproducible. Further, as the Bi is added as oxide, if present, instead of alloying in the FeSi alloy, it is easy to vary the bismuth amount in the inoculant, e.g. for smaller production series. Further, although Bi is known to have a high inoculating power, the oxygen is also of importance for the performance of the present inoculant, hence, providing another advantage of adding Bi as an oxide.

The amount of particulate $Sb_2O_3$, if present, should be from 0.1 to 15% by weight based on the total amount of the inoculant. In some embodiments the amount of $Sb_2O_3$ can be 0.1-8% by weight. The amount of $Sb_2O_3$ can also be from about 0.5 to about 3.5% by weight, based on the total weight of inoculant.

The amount of particulate $Sb_2S_3$, if present, should be from 0.1 to 15% by weight based on the total amount of the inoculant. In some embodiments, the amount of $Sb_2S_3$ can be 0.1-8% by weight. Good results are also observed when the amount of $Sb_2S_3$ is from about 0.5 to about 3.5% by weight, based on the total weight of inoculant. The particle size of $Sb_2O_3$ and $Sb_2S_3$ is typically 10-150 μm.

Adding Sb in the form $Sb_2S_3$ particles and/or $Sb_2O_3$ particles instead of alloying Sb with the FeSi alloy, provides several advantages. Although Sb is a powerful inoculant, the oxygen and sulphur are also of importance for the performance of the inoculant. Another advantage is the good reproducibility, and flexibility, of the inoculant composition since the amount and the homogeneity of particulate $Sb_2S_3$ and/or $Sb_2O_3$ in the inoculant are easily controlled. The importance of controlling the amount of inoculants and having a homogenous composition of the inoculant is evident given the fact that antimony is normally added at a ppm level. Adding an inhomogeneous inoculant may result in wrong amounts of inoculating elements in the cast iron. Still another advantage is the more cost effective production of the inoculant compared to methods involving alloying antimony in a FeSi based alloy.

The total amount of one or more of particulate $Fe_3O_4$, $Fe_2O_3$, FeO, or a mixture thereof, if present, should be from 0.1 to 5% by weight based on the total amount of the inoculant. In some embodiments the amount of one or more of $Fe_3O_4$, $Fe_2O_3$, FeO, or a mixture thereof can be 0.5-3% by weight. The amount of one or more of $Fe_3O_4$, $Fe_2O_3$, FeO, or a mixture thereof can also be from about 0.8 to about 2.5% by weight, based on the total weight of inoculant. Commercial iron oxide products for industrial applications, such as in the metallurgy field, might have a composition comprising different types of iron oxide compounds and phases. The main types of iron oxide being $Fe_3O_4$, $Fe_2O_3$, and/or FeO (including other mixed oxide phases of $Fe^{II}$ and $Fe^{III}$; iron(II,III)oxides), all which can be used in the inoculant according to the present invention. Commercial iron oxide products for industrial applications might comprise minor (insignificant) amounts of other metal oxides as impurities.

The total amount of one or more of particulate FeS, $FeS_2$, $Fe_3S_4$, or a mixture thereof, if present, should be from 0.1 to 5% by weight based on the total amount of the inoculant. In some embodiments the amount of one or more of FeS, $FeS_2$, $Fe_3S_4$, or a mixture thereof can be 0.5-3% by weight. The amount of one or more of FeS, $FeS_2$, $Fe_3S_4$, or a mixture thereof can also be from about 0.8 to about 2.5% by weight, based on the total weight of inoculant. Commercial iron sulphide products for industrial applications, such as in the metallurgy field, might have a composition comprising different types of iron sulphide compounds and phases. The main types of iron sulphides being FeS, $FeS_2$ and/or $Fe_3S_4$ (iron(II, III)sulphide; FeS, $Fe_2S_3$), including non-stoichiometric phases of FeS; $Fe_{1+x}S$ (x>0 to 0.1) and $Fe_{1-y}S$ (y>0 to 0.2), all which can be used in the inoculant according to the present invention. A commercial iron sulphide product for industrial applications might comprise minor (insignificant) amounts of other metal sulphides as impurities.

One of the purposes of adding of one or more of $Fe_3O_4$, $Fe_2O_3$, FeO, or a mixture thereof and/or one or more of FeS, $FeS_2$, $Fe_3S_4$, or a mixture thereof into the cast iron melt is to deliberately add oxygen and sulphur into the melt, which may contribute to increase the nodule count.

It should be understood that the total amount of the RE-oxide particles, and the at least one of Sb oxide/sulphide particles, Bi oxide/sulphide particles, and any Fe oxide/sulphide, if present, should be up to about 20% by weight, based on the total weight of the inoculant. It should also be understood that the composition of the FeSi base alloy may vary within the defined ranges, and the skilled person will know that the amounts of the alloying elements add up to 100%. There exists a plurality of conventional FeSi based inoculant alloys, and the skilled person would know how to vary the FeSi base composition based on these.

The addition rate of the inoculant according to the present invention to a cast iron melt is typically from about 0.1 to 0.8% by weight. The skilled person would adjust the addition rate depending on the levels of the elements, e.g. an inoculant with high Bi and/or high Sb will typically need a lower addition rate.

The present inoculant is produced by providing a particulate FeSi base alloy having the composition as defined herein, and adding to the said particulate base rare earth metal oxide(s) and at least one of the particulate $Sb_2O_3$/$Sb_2S_3$/$Bi_2O_3$/$Bi_2S_3$, and optionally one or more of $Fe_3O_4$, $Fe_2O_3$, FeO, or a mixture thereof and/or one or more of FeS, $FeS_2$, $Fe_3S_4$, or a mixture thereof, to produce the present inoculant. The rare earth metal oxide(s) and the at least one of $Sb_2O_3$, $Sb_2S_3$, $B_2O_3$ and/or $Bi_2S_3$ particles, as well as the Fe oxide/sulphide particles, if present, may be mechanically/physically mixed with the FeSi base alloy particles. Any suitable mixer for mixing/blending particulate and/or powder materials may be used. The mixing may be performed in the presence of a suitable binder, however it should be noted that the presence of a binder is not required. The rare earth metal oxide(s) and the at least one of $Sb_2O_3$, $Sb_2S_3$, $B_2O_3$ and/or $Bi_2S_3$ particles, as well as the Fe oxide/sulphide particles, if present, may also be blended with the FeSi base alloy particles, providing a homogenously mixed inoculant Blending the rare earth metal oxide(s), and said additional sulphide/oxide powders, with the FeSi base alloy particles, may form a stable coating on the FeSi base alloy particles. It should however be noted that mixing and/or blending the rare earth metal oxide(s) and any other of the said particulate oxides/sulphides, with the particulate FeSi base alloy is not mandatory for achieving the inoculating effect. The particulate FeSi base alloy and rare earth metal oxide(s), and any of the said particulate oxides/sulphides, may be added separately but simultaneously to the liquid cast iron. The inoculant may also be added as an in-mould inoculant. The inoculant particles of FeSi alloy, rare earth metal oxide(s), and any of the said particulate Bi oxide/sulphide, Sb oxide/sulphide and/or Fe oxide/sulphide, if present, may also be formed to agglomerates or briquettes according to generally known methods.

The following Examples show that the addition of rare earth metal oxide(s) and $Sb_2O_3$/$Sb_2S_3$/$Bi_2O_3$/$Bi_2S_3$ particles together with FeSi base alloy particles results in an increased nodule number density when the inoculant is added to cast iron, compared to an inoculant according to the prior art in WO 99/29911, as defined below. A higher nodule count allows reducing the amount of inoculant necessary to achieve the desired inoculating effect.

EXAMPLES

All test samples were analysed with respect to the microstructure to determine the nodule density. The microstructure was examined in one tensile bar from each trial according to ASTM E2567-2016. Particle limit was set to >10 μm. The tensile samples were Ø28 mm cast in standard moulds according to ISO1083-2004, and were cut and prepared according to standard practice for microstructure analysis before evaluating by use of automatic image analysis software. The nodule density (also denoted nodule number density) is the number of nodules (also denoted nodule count) per $mm^2$, abbreviated $N/mm^2$.

The iron oxide used in the following examples, was a commercial magnetite ($Fe_3O_4$) with the specification (supplied by the producer); $Fe_3O_4$>97.0%; $SiO_2$<1.0%. The commercial magnetite product probably included other iron oxide forms, such as $Fe_2O_3$ and FeO. The main impurity in the commercial magnetite was $SiO_2$, as indicated above.

The iron sulphide used in the following examples, was a commercial FeS product. An analysis of the commercial product indicated presence of other iron sulphide compounds/phases in addition to FeS, and normal impurities in insignificant amounts.

Example 1

Two melts, Melt P and Melt Q, were prepared and each melt was treated in a tundish cover ladle by 1.20-1.25% by weight of a standard MgFeSi nodularising alloy having a composition of (% by weight) 46.0% Si; 4.33% Mg; 0.69% Ca; 0.44% RE; 0.44% Al, balance Fe and incidental impurities in the ordinary amount (RE is Rare Earth metals containing approx. 65% Ce and 35% La). 0.7% by weight of steel chips were used as cover. The MgFeSi treatment was done at 1500° C. Inoculation trials were performed out of each magnesium treated melt, as shown in table 1, with an addition rate of 0.2 wt %. The holding time was from filling the pouring ladle containing the inoculant to pouring was 1 minute for all trials. The pouring temperatures were 1392-1365° C. for Melt P and 1384-1370° C. for Melt Q. In this example, the treated melts were cast as a step block. The section analysed for the nodule count had a thickness of 20 mm. The final cast iron chemical compositions for all treatments were within 3.4-3.6 wt % C, 2.3-2.5 wt % Si, 0.29-0.31 wt % Mn, 0.007-0.011 wt % S, 0.040-0.043 wt % Mg.

A base FeSi alloy, for an inoculant according to the present invention, had a composition of (in % by weight) 75% Si; 1.57% Al; 1.19% Ca; balance Fe and incidental impurities in the ordinary amount, herein denoted Inoculant A. The Inoculant A base alloy was coated with $CeO_2$ and $Bi_2S_3$ in amounts as shown in table 1.

Another base FeSi alloy, for an inoculant according to the present invention, had a composition of (in % by weight) 68.2% Si; 0.93% Al; 0.94% Ba; 0.95% Ca; balance Fe and incidental impurities in the ordinary amount, herein denoted Inoculant B. The Inoculant A and Inoculant B base alloy particles were coated with $CeO_2$ and $Bi_2S_3$ in amounts as shown in table 1.

The prior art inoculant was an inoculant according to WO99/29911, having a base alloy composition of (in % by weight) 74.2% Si; 0.97% Al; 0.78% Ca; 1.55% Ce, balance Fe and incidental impurities in the ordinary amount, herein denoted Inoculant X.

The added amounts of particulate $CeO_2$ and particulate $Bi_2S_3$, to the FeSi base alloys (Inoculant A and Inoculant B) are shown in Table 1, together with the inoculant according to the prior art. The amounts of $CeO_2$, $Bi_2S_3$, FeS and $Fe_3O_4$ are based on the total weight of the inoculants in all tests. The amounts of $CeO_2$, $Bi_2S_3$ FeS and $Fe_3O_4$ are the percentage of compound.

TABLE 1

Inoculant compositions.

| | | Additions, wt-% | | | | | |
|---|---|---|---|---|---|---|---|
| | Base inoculant | FeS | $Fe_3O_4$ | $CeO_2$ | $Bi_2O_3$ | $Bi_2S_3$ | Reference |
| Melt P | Inoculant X | 1.00 | 2.00 | | | | Prior art |
| | Inoculant A | | | 0.37 | 0.67 | | Inoculant A + CeO2/Bi2O3 |
| Melt Q | Inoculant X | 1.00 | 2.00 | | | | Prior art |
| | Inoculant B | | | 1.47 | | 0.74 | Inoculant B + CeO2/Bi2S3 |

Figure 2:
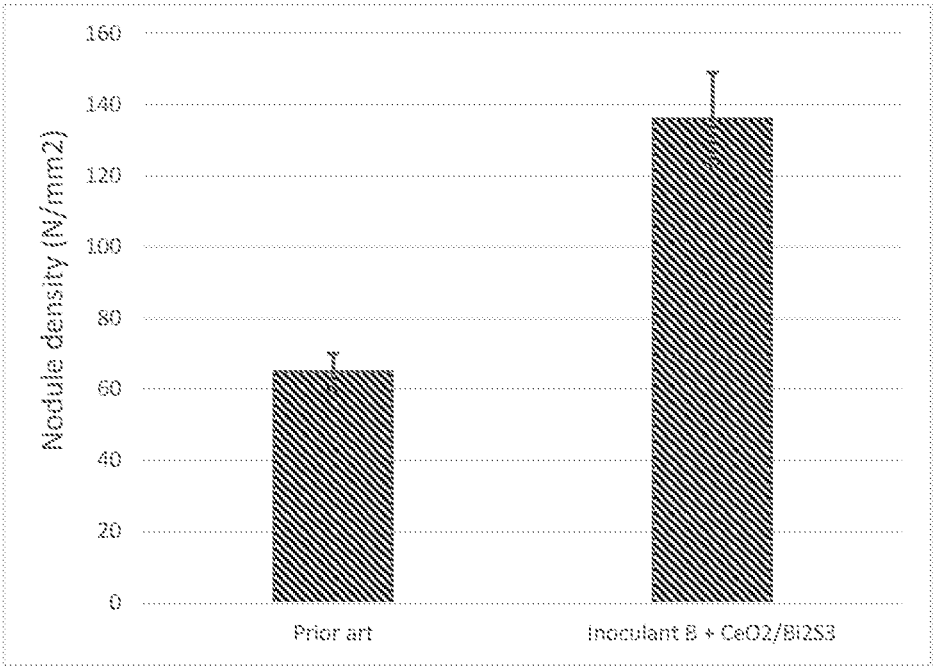
FIG. 2: diagram showing nodule number density (nodule number per $mm^2$, abbreviated $N/mm^2$) in cast iron samples of Melt Q in example 1.

The nodule density in the cast irons from the inoculation trials in Melt P are shown in FIG. 1, and the nodule density in the cast irons from the inoculation trials in Melt Q are shown in FIG. 2.

Analysis of the microstructure showed that both the inoculants according to the present invention had significantly higher nodule density, compared to the prior art inoculant.

Example 2

Three iron melts, Melt W, Y and Z, were prepared and each melt was treated in a tundish over ladle by 1.20-1.25% by weight of a standard MgFeSi nodularising alloy having a composition of (% by weight) 46.0% Si; 4.33% Mg; 0.69% Ca; 0.44% RE; 0.44% Al, balance Fe and incidental impurities in the ordinary amount (RE is Rare Earth metals containing approx. 65% Ce and 35% La). 0.7% by weight of steel chips were used as cover. The MgFeSi treatment was done at 1500° C. Inoculation trials were performed out of each magnesium treated melt, as shown in table 2, with an addition rate of 0.2 wt %. The holding time was from filling the pouring ladle containing the inoculant to pouring was 1 minute for all trials. The pouring temperatures were 1370-1353° C. for Melt W and 1389-1361° C. for Melt Y, and 1381-1363° C. for Melt Z. The final cast iron chemical compositions for all treatments were within 3.5-3.7 wt % C, 2.3-2.5 wt % Si, 0.29-0.31 wt % Mn, 0.007-0.011 wt % S, 0.040-0.043 wt % Mg.

The compositions of the particulate base FeSi alloys were the same as specified in Example 1. The Inoculant A base alloy particles were coated with particulate $CeO_2$, and particulate $Bi_2S_3$, $Bi_2O_3$, $Sb_2S_3$ and/or $Sb_2O_3$ in amounts as shown in table 2. The prior art inoculant was an inoculant according to WO99/29911, having a base alloy composition, Inoculant X, as defined in Example 1.

The added amounts of particulate $CeO_2$ and particulate $Bi_2S_3$, $Bi_2O_3$, $Sb_2S_3$ and $Sb_2O_3$, to the FeSi base alloy (Inoculant A) are shown in Table 2, together with the inoculant according to the prior art. The amounts of $CeO_2$, $Bi_2S_3$, $Bi_2O_3$, $Sb_2S_3$, $Sb_2O_3$, FeS and $Fe_3O_4$ are the percentage of compound, based on the total weight of the inoculants in all tests.

TABLE 2

Inoculant compositions.

| | Base | Additions, wt-% | | | | | | | |
|---|---|---|---|---|---|---|---|---|---|
| | inoculant | FeS | $Fe_3O_4$ | $CeO_2$ | $Bi_2S_3$ | $Bi_2O_3$ | $Sb_2S_3$ | $Sb_2O_3$ | Reference |
| Melt W | Inoculant X | 1.00 | 2.00 | | | | | — | Prior art |
| | Inoculant A | | | 1.23 | 1.23 | 1.11 | | | Inoculant A+ CeO2/Bi2S3/Bi2O3 |
| | Inoculant A | | | 1.23 | | | 2.79 | | Inoculant A + CeO2/Sb2S3 |
| Melt Y | Inoculant X | 1.00 | 2.00 | | | | | | Prior art |
| | Inoculant A | | | 1.23 | | 1.11 | 1.39 | | Inoculant A + CeO2/Bi2O3/Sb2S3 |
| | Inoculant A | | | 1.23 | 1.23 | | | 1.20 | Inoculant A + CeO2/Bi2S3/Sb2O3 |
| | Inoculant A | | | 1.23 | | 1.11 | | 1.20 | Inoculant A + CeO2/Bi2O3/Sb2O3 |
| | Inoculant A | | | 1.23 | 1.23 | | 1.39 | | Inoculant A + CeO2/Bi2S3/Sb2S3 |
| Melt Z | Inoculant X | 1.00 | 2.00 | | | | | | Prior art |
| | Inoculant A | | | 9.83 | | 3.34 | | | Inoculant A + CeO2/Bi2O3 |

Figure 3:
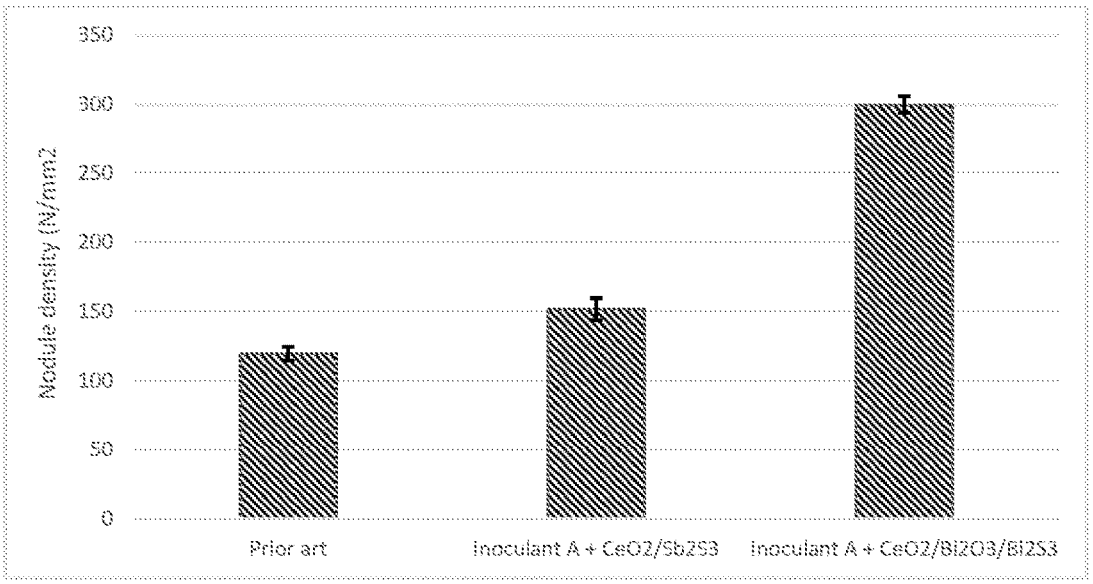
FIG. 3: diagram showing nodule number density (nodule number per $mm^2$, abbreviated $N/mm^2$) in cast iron samples of Melt W in example 2.

The nodule density in the cast irons from the inoculation trials in Melt W are shown in FIG. 3. The analysis of the microstructure showed that the inoculant according to the present invention, a particulate FeSi base alloy (Inoculant A) coated with cerium oxide, bismuth oxide and bismuth sulphide had a very significantly higher nodule density, compared to the prior art inoculant.

Figure 4:
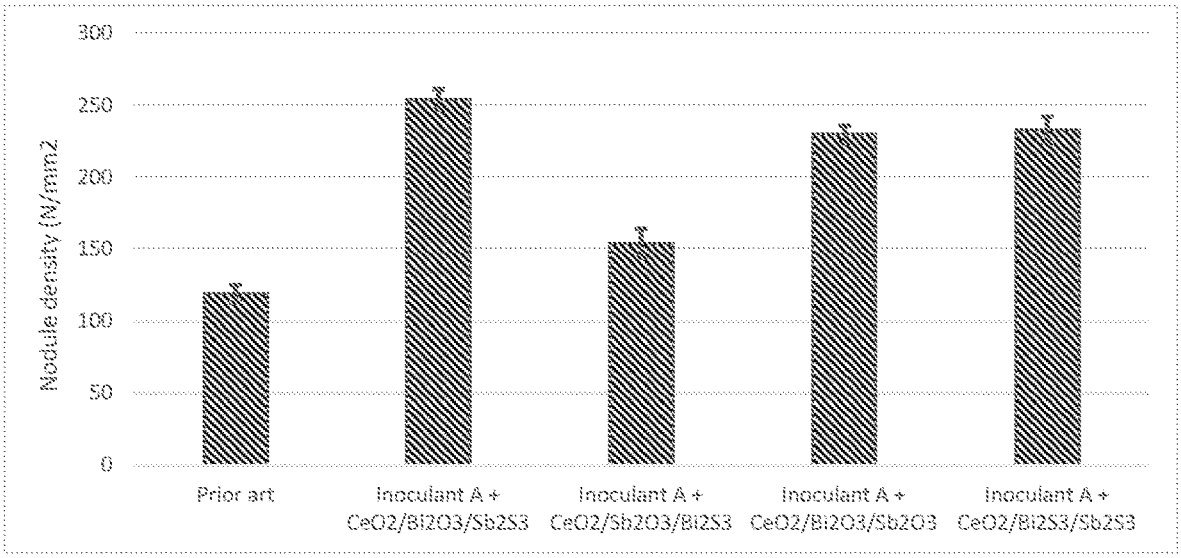
FIG. 4: diagram showing nodule number density (nodule number per $mm^2$, abbreviated $N/mm^2$) in cast iron samples of Melt Y in example 2.

FIG. 4 shows the nodule density in the cast irons from the inoculation trials in Melt Y. The analysis of the microstructure showed that all inoculants according to the present invention; a particulate FeSi base alloy (Inoculant A) coated with cerium oxide, together with a combination of bismuth oxide, bismuth sulphide, antimony oxide and/or antimony sulphide, had a significantly higher nodule density, compared to the prior art inoculant.

Figure 5:
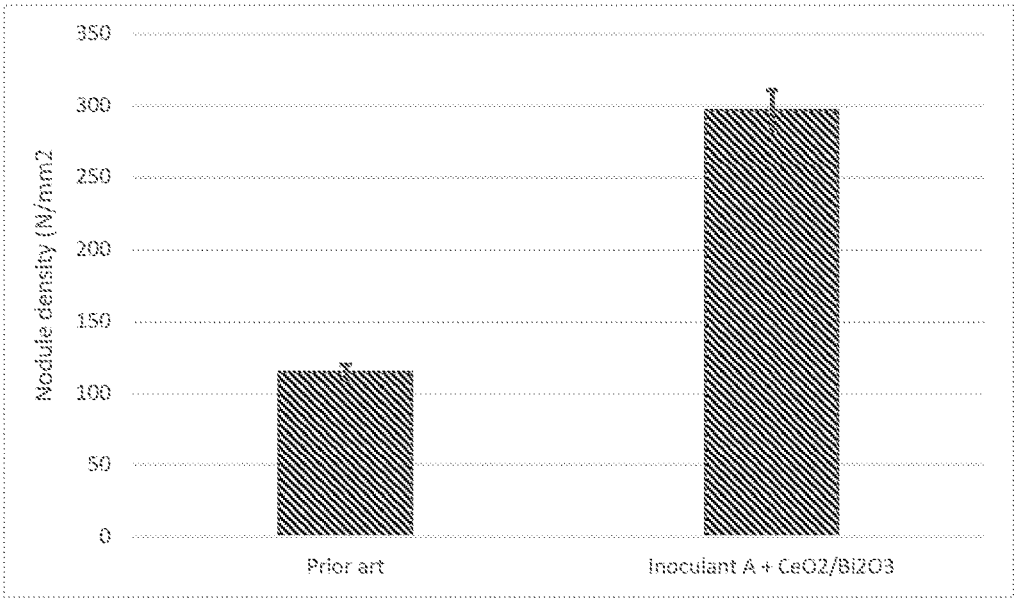
FIG. 5: diagram showing nodule number density (nodule number per $mm^2$, abbreviated $N/mm^2$) in cast iron samples of Melt Z in example 2.

FIG. 5 shows the nodule density in the cast irons from the inoculation trials in Melt Z, having a high content of $CeO_2$ in addition to $Bi_2O_3$. The analysis of the microstructure the inoculant according to the present invention; a particulate FeSi base alloy (Inoculant A) coated with cerium oxide, together with bismuth oxide, had a very significantly higher nodule density, compared to the prior art inoculant.

Example 3

Two cast iron melts, Melt AG and Melt AH, each of 275 kg were prepared and treated by 1.20-1.25 wt-% MgFeSi nodulariser of the composition, in wt % 46.0% Si, 4.33% Mg, 0.69% Ca, 0.44% RE, 0.44% Al, balance Fe and incidental impurities, in a tundish cover ladle. 0.7% by weight steel chips were used as cover. Addition rates for all inoculants were 0.2% by weight added to each pouring ladle. The MgFeSi treatment temperature was 1500° C. and pouring temperatures were 1390-1362° C. for Melt AG and 1387-1361° C. for Melt AH. Holding time from filling the pouring ladles to pouring was 1 minute for all trials. The chemical composition for all treatments was within 3.5-3.7 wt % C, 2.3-2.5 wt % Si, 0.29-0.31 wt % Mn, 0.009-0.011 wt % S, 0.04-0.05 wt % Mg.

The added amounts of particulate $La_2O_3$, $Y_2O_3$ and $CeO_2$ and particulate $Bi_2O_3$ and $Sb_2O_3$, to the FeSi base alloys (Inoculant A, Inoculant B and Inoculant X, as defined in Example 1) are shown in Table 3 and 4, together with the inoculant according to the prior art. The amounts of particulate $La_2O_3$, $Y_2O_3$ and $CeO_2$ and particulate $Bi_2O_3$ $Sb_2O_3$, FeS and $Fe_3O_4$ are the percentage of compound, based on the total weight of the inoculants in all tests.

TABLE 3

Inoculant compositions.

| | Base | Additions, wt-% | | | | | |
|---|---|---|---|---|---|---|---|
| | inoculant | FeS | $Fe_3O_4$ | $La_2O_3$ | $Bi_2O_3$ | $Sb_2O_3$ | Reference |
| Melt AG | Inoculant X | 1.00 | 2.00 | | | | Prior art |
| | Inoculant A | | | 1.17 | | 2.39 | InoculantA + La2O3/Sb2O3 |
| | Inoculant A | | | 1.17 | 1.11 | 1.20 | InoculantA + La2O3/Sb2O3/Bi2O3 |
| | Inoculant B | | | 1.17 | 2.23 | | InoculantB + La2O3/Bi2O3 |

Figure 6:
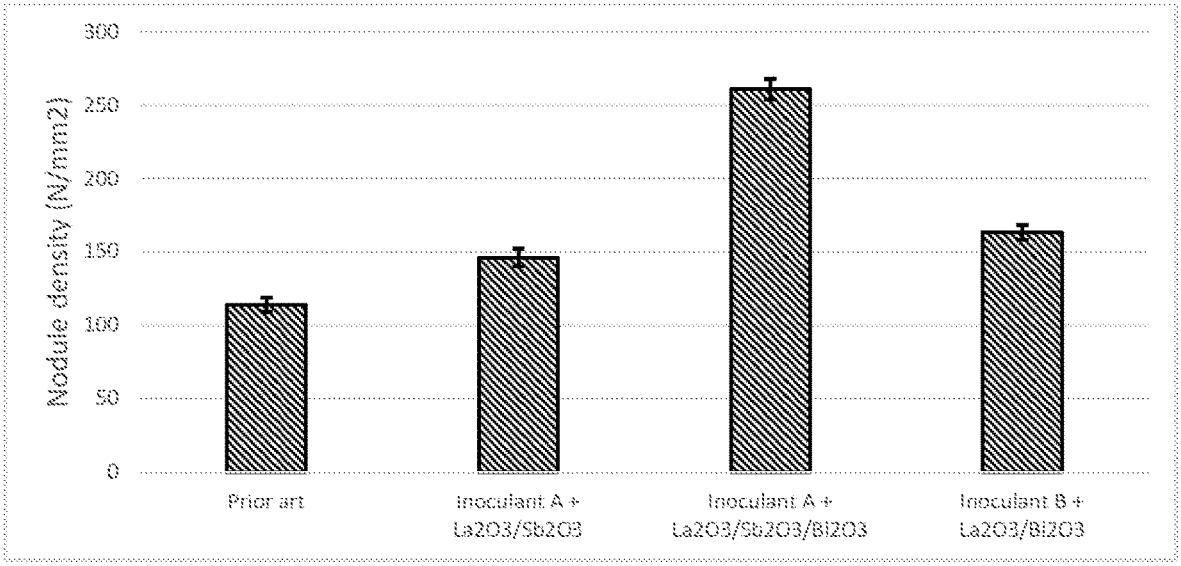
FIG. 6: diagram showing nodule number density (nodule number per $mm^2$, abbreviated $N/mm^2$) in cast iron samples of Melt AG in example 3.

The nodule density in the cast irons from the inoculation trials in Melt AG are shown in FIG. 6. The analysis of the microstructure showed that the inoculant according to the present invention, a particulate FeSi base alloy (Inoculant A or Inoculant B) coated with lanthanum oxide, bismuth oxide and/or antimony oxide had a very significantly higher nodule density, compared to the prior art inoculant.

TABLE 4

Inoculant compositions.

| | Base inoculant | Additions, wt-% FeS | $Fe_3O_4$ | $Y_2O_3$ | $CeO_2$ | $Bi_2O_3$ | $Sb_2O_3$ | Reference |
|---|---|---|---|---|---|---|---|---|
| Melt AH | Inoculant X | 1.00 | 2.00 | | | | | Prior art |
| | Inoculant A | | | 1.27 | | 2.23 | | InoculantA + Y2O3/Bi2O3 |
| | Inoculant A | | | 1.27 | | | 2.39 | InoculantA + Y2O3/Sb2O3 |
| | Inoculant B | | | | 1.23 | 1.11 | 1.20 | InoculantB + Ce2O3/Sb2O3/Bi2O3 |

Figure 7:
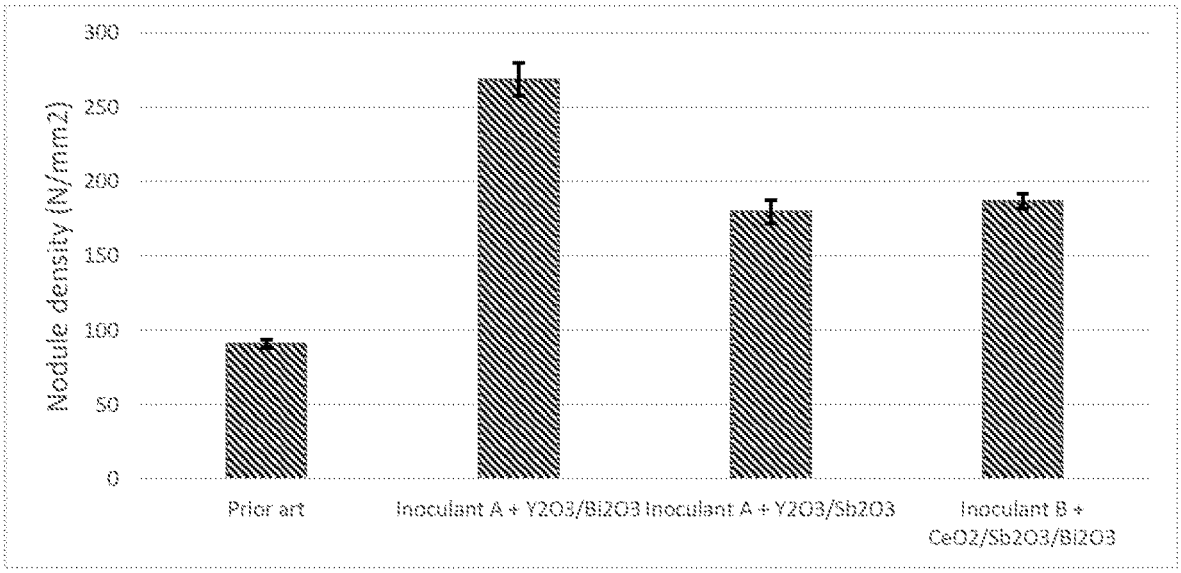
FIG. 7: diagram showing nodule number density (nodule number per $mm^2$, abbreviated $N/mm^2$) in cast iron samples of Melt AH in example 3.

The nodule density in the cast irons from the inoculation trials in Melt AH are shown in FIG. 7. The analysis of the microstructure showed that the inoculant according to the present invention, a particulate FeSi base alloy (Inoculant A or Inoculant B) coated with yttrium oxide or cerium oxide, combined with bismuth oxide and/or antimony oxide had a very significantly higher nodule density, compared to the prior art inoculant.

Example 4

One cast iron melt, Melt AK of 275 kg was prepared and treated by 1.20-1.25 wt-% MgFeSi nodulariser alloy of the composition: 46.0 wt % Si, 4.33 wt % Mg, 0.69 wt % Ca, 0.44% RE, 0.44% Al, balance Fe and incidental impurities, in a tundish cover ladle. 0.7% by weight steel chips were used as cover. From the treatment ladle, the melt was poured over to pouring ladles. Addition rates for all inoculants were 0.2% by weight added to each pouring ladle. The MgFeSi treatment temperature was 1500° C. and pouring temperatures were 1378-1368° C. The holding time from filling the pouring ladles to pouring was 1 minute for all trials.

The test inoculants had ferrosilicon base alloys of composition of the prior art as described in Example 1 (herein denoted Inoculant X, with composition as defined in Example 1) and of composition: 74 wt % Si, 2.42 wt % Ca, 1.73 wt % Zr, 1.23 wt % Al herein denoted Inoculant C. The base ferrosilicon alloy particles (Inoculant C) were coated by particulate $CeO_2$ and particulate $Sb_2O_3$ by mechanically mixing to obtain a homogenous mixture.

The chemical composition for all treatments was within 3.5-3.7 wt % C, 2.3-2.5 wt % Si, 0.29-0.31 wt % Mn, 0.009-0.011 wt % S, 0.04-0.05 wt % Mg.

The added amounts of particulate $CeO_2$ and particulate $Sb_2O_3$, to the FeSi base alloy (Inoculant C) are shown in Table 5, together with the inoculant according to the prior art. The amounts of $CeO_2$. $Sb_2O_3$, FeS and $Fe_3O_4$ are the percentages of compounds, based on the total weight of the inoculants in all tests.

TABLE 5

Inoculant compositions.

| | Base inoculant | Additions, wt-% FeS | $Fe_3O_4$ | $CeO_2$ | $Sb_2O_3$ | Reference |
|---|---|---|---|---|---|---|
| Melt AK | Inoculant X | 1.00 | 2.00 | | | Prior art |
| | Inoculant C | | | 0.61 | 1.20 | Inoculant C + $CeO_2$/Sb2O3 |

Figure 8:
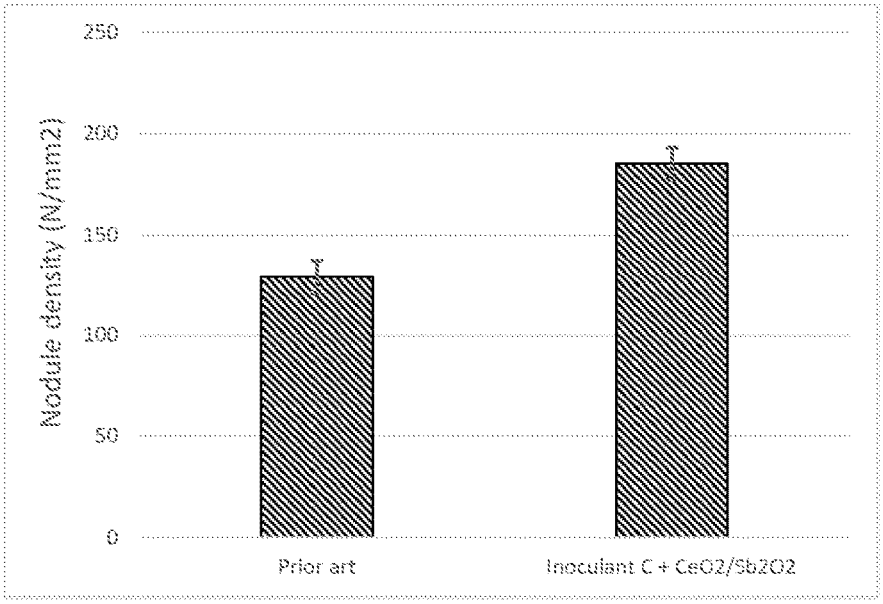
FIG. 8: diagram showing nodule number density (nodule number per $mm^2$, abbreviated $N/mm^2$) in cast iron samples of Melt AK in example 4.

The nodule density in the cast irons from the inoculation trials in Melt AK are shown in FIG. 8. Analysis of the microstructure showed that the inoculant according to the present invention (Inoculant C+CeO2/Sb2O3) had significantly higher nodule density, compared to the prior art inoculant.

Having described different embodiments of the invention it will be apparent to those skilled in the art that other embodiments incorporating the concepts may be used. These and other examples of the invention illustrated above and in the accompanying drawings are intended by way of example only and the actual scope of the invention is to be determined from the following claims.

The invention claimed is:

1. An inoculant for the manufacture of cast iron with spheroidal graphite, said inoculant comprises a particulate ferrosilicon alloy consisting of
- between 40 and 80% by weight of Si,
- 0.02-8% by weight of Ca;
- 0-5% by weight of Sr;
- 0-12% by weight of Ba;
- 0-10% by weight of rare earth metal;
- 0-5% by weight of Mg;
- 0.05-5% by weight of Al;
- 0-10% by weight of Mn;
- 0-10% by weight of Ti;
- 0-10% by weight of Zr;

balance being Fe and incidental impurities in the ordinary amount, wherein said inoculant additionally contains, by weight, based on the total weight of inoculant:

0.1 to 15% by weight of particulate rare earth metal oxide(s), and at least one of from 0.1 to 15% of particulate $Bi_2O_3$, and/or from 0.1 to 15% of particulate $Bi_2S_3$, and/or from 0.1 to 15% of particulate $Sb_2O_3$, and/or from 0.1 to 15% of particulate $Sb_2S_3$, and optionally from 0.1 to 5% of one of more of particulate $Fe_3O_4$, $Fe_2O_3$, FeO, or a mixture thereof, and/or from 0.1 to 5% of one of more of particulate FeS, $FeS_2$, $Fe_3S_4$, or a mixture thereof.

2. The inoculant according to claim 1, wherein the ferrosilicon alloy comprises between 45 and 60% by weight of Si.

3. The inoculant according to claim 1, wherein the ferrosilicon alloy comprises between 60 and 80% by weight of Si.

4. The inoculant according to claim 1, wherein the rare earth metals include Ce, La, Y and/or mischmetal.

5. The inoculant according to claim 1, wherein the inoculant comprises 0.2 to 12% by weight of particulate rare earth metal oxide(s).

6. The inoculant according to claim 1, wherein the rare earth metal oxide(s) is (are) $CeO_2$ and/or $La_2O_3$ and/or $Y_2O_3$.

7. The inoculant according to claim 1, wherein the inoculant comprises from 0.3 to 10% of particulate $Bi_2O_3$.

8. The inoculant according to claim 1, wherein the inoculant comprises from 0.3 to 10% of particulate $Bi_2S_3$.

9. An inoculant for the manufacture of cast iron with spheroidal graphite, said inoculant comprises a particulate ferrosilicon alloy consisting of
between 40 and 80% by weight of Si,
0.02-8% by weight of Ca;
0-5% by weight of Sr;
0-12% by weight of Ba;
0-10% by weight of rare earth metal;
0-5% by weight of Mg;
0.05-5% by weight of Al;
0-10% by weight of Mn;
0-10% by weight of Ti;
0-10% by weight of Zr;
balance being Fe and incidental impurities in the ordinary amount, wherein said inoculant additionally contains, by weight, based on the total weight of inoculant:
0.1 to 15% by weight of particulate rare earth metal oxide(s), and
at least one of from 0.1 to 15% of particulate $Bi_2O_3$, and/or from 0.1 to 15% of particulate $Bi_2S_3$, and/or from 0.1 to 15% of particulate $Sb_2S_3$, and
optionally from 0.1 to 5% of one of more of particulate $Fe_3O_4$, $Fe_2O_3$, FeO, or a mixture thereof, and/or from 0.1 to 5% of one of more of particulate FeS, $FeS_2$, $Fe_3S_4$, or a mixture thereof, wherein the inoculant further comprises from 0.3 to 10% of particulate $Sb_2O_3$.

10. An inoculant for the manufacture of cast iron with spheroidal graphite, said inoculant comprises a particulate ferrosilicon alloy consisting of
between 40 and 80% by weight of Si,
0.02-8% by weight of Ca;
0-5% by weight of Sr;
0-12% by weight of Ba;
0-10% by weight of rare earth metal;
0-5% by weight of Ma;
0.05-5% by weight of Al;
0-10% by weight of Mn;
0-10% by weight of Ti;
0-10% by weight of Zr;
balance being Fe and incidental impurities in the ordinary amount, wherein said inoculant additionally contains, by weight, based on the total weight of inoculant:
0.1 to 15% by weight of particulate rare earth metal oxide(s), and
at least one of from 0.1 to 15% of particulate $Bi_2O_3$, and/or from 0.1 to 15% of particulate $Bi_2S_3$, and/or from 0.1 to 15% of particulate $Sb_2O_3$, and
optionally from 0.1 to 5% of one of more of particulate $Fe_3O_4$, $Fe_2O_3$, FeO, or a mixture thereof, and/or from 0.1 to 5% of one of more of particulate FeS, $FeS_2$, $Fe_3S_4$, or a mixture thereof, wherein the inoculant further comprises from 0.3 to 10% of particulate $Sb_2S_3$.

11. The inoculant according to claim 1, wherein the inoculant comprises from 0.5 to 3% of one of more of particulate $Fe_3O_4$, $Fe_2O_3$, FeO, or a mixture thereof, and/or from 0.5 to 3% of one of more of particulate FeS, $FeS_2$, $Fe_3S_4$, or a mixture thereof.

12. The inoculant according to claim 1, wherein the total amount of the particulate rare earth metal oxide(s) and the at least one of particulate $Bi_2O_3$, and/or particulate $Bi_2S_3$, particulate $Sb_2O_3$, and/or particulate $Sb_2S_3$, and/or one of more of particulate $Fe_3O_4$, $Fe_2O_3$, FeO, or a mixture thereof, and/or one of more of particulate FeS, $FeS_2$, $Fe_3S_4$, or a mixture thereof is up to 20% by weight, based on the total weight of the inoculant.

13. The inoculant according to claim 1, wherein the inoculant is in the form of a blend or a physical mixture of the particulate ferrosilicon alloy and the particulate rare earth metal oxide(s), and the at least one particulate $Bi_2O_3$, particulate $Bi_2S_3$, particulate $Sb_2O_3$, particulate $Sb_2S_3$, one of more of particulate $Fe_3O_4$, $Fe_2O_3$, FeO, or a mixture thereof and/or one of more of particulate FeS, $FeS_2$, $Fe_3S_4$, or a mixture thereof.

14. The inoculant according to claim 1, wherein the particulate rare earth metal oxide(s), and the at least one particulate $Bi_2O_3$, particulate $Bi_2S_3$, particulate $Sb_2O_3$, particulate $Sb_2S_3$, one of more of particulate $Fe_3O_4$, $Fe_2O_3$, FeO, or a mixture thereof and/or one of more of particulate FeS, $FeS_2$, $Fe_3S_4$, or a mixture thereof are present as coating compounds on the particulate ferrosilicon based alloy.

15. The inoculant according to claim 1, wherein the inoculant is in the form of agglomerates made from a mixture of the particulate ferrosilicon alloy and the particulate rare earth metal oxide(s), and the at least one particulate $Bi_2O_3$, particulate $Bi_2S_3$, particulate $Sb_2O_3$, particulate $Sb_2S_3$, one of more of particulate $Fe_3O_4$, $Fe_2O_3$, FeO, or a mixture thereof and/or one of more of particulate FeS, $FeS_2$, $Fe_3S_4$, or a mixture thereof.

16. The inoculant according to claim 1, wherein the inoculant is in the form of briquettes made from a mixture of the particulate ferrosilicon alloy and the particulate rare earth metal oxide(s), and the at least one particulate $Bi_2O_3$, particulate $Bi_2S_3$, particulate $Sb_2O_3$, particulate $Sb_2S_3$, one of more of particulate $Fe_3O_4$, $Fe_2O_3$, FeO, or a mixture thereof and/or one of more of particulate FeS, $FeS_2$, $Fe_3S_4$, or a mixture thereof.

17. The inoculant according to claim 1, wherein the particulate ferrosilicon based alloy and the particulate rare earth metal oxide(s), and the at least one particulate $Bi_2O_3$, particulate $Bi_2S_3$, particulate $Sb_2O_3$, particulate $Sb_2S_3$, one of more of particulate $Fe_3O_4$, $Fe_2O_3$, FeO, or a mixture thereof and/or one of more of particulate FeS, $FeS_2$, $Fe_3S_4$, or a mixture thereof, are added separately but simultaneously to liquid cast iron.

18. A method for producing an inoculant according to claim 1, comprising:

providing a particulate base alloy comprising
between 40 to 80% by weight of Si,
0.02-8% by weight of Ca;
0-5% by weight of Sr;
0-12% by weight of Ba;
0-10% by weight of rare earth metal;
0-5% by weight of Mg;
0.05-5% by weight of Al;
0-10% by weight of Mn;
0-10% by weight of Ti;
0-10% by weight of Zr;

the balance being Fe and incidental impurities in the ordinary amount, and adding to the said particulate base, by weight, based on the total weight of inoculant,
0.1 to 15% by weight of particulate rare earth metal oxide(s) and at least one of from 0.1 to 15% of particulate $Bi_2O_3$, and/or from 0.1 to 15% of particulate $Bi_2S_3$, and/or from 0.1 to 15% of particulate $Sb_2O_3$, and/or from 0.1 to 15% of particulate $Sb_2S_3$, and optionally from 0.1 to 5% of one of more of particulate $Fe_3O_4$, $Fe_2O_3$, FeO, or a mixture thereof, and/or from 0.1 to 5% of one of more of particulate FeS, $FeS_2$, $Fe_3S_4$, or a mixture thereof, to produce said inoculant.

19. The method according to claim 18, wherein the particulate rare earth metal oxide(s), and the particulate $Bi_2O_3$, and/or the particulate $Bi_2S_3$, and/or the particulate $Sb_2O_3$, the particulate $Sb_2S_3$, the one of more of particulate $Fe_3O_4$, $Fe_2O_3$, FeO, or a mixture thereof, and/or the one of more of particulate FeS, $FeS_2$, $Fe_3S_4$, or a mixture thereof, are mixed or blended with the particulate base alloy.

20. The method according to claim 18, wherein the particulate rare earth metal oxide(s), and the particulate $Bi_2O_3$, and/or the particulate $Bi_2S_3$, and/or the particulate $Sb_2O_3$, the particulate $Sb_2S_3$, the one of more of particulate $Fe_3O_4$, $Fe_2O_3$, FeO, or a mixture thereof, and/or the one of more of particulate FeS, $FeS_2$, $Fe_3S_4$, or a mixture thereof, are mixed before being mixed with the particulate base alloy.

21. Method for manufacturing cast iron with spheroidal graphite, by adding the inoculant according to claim 1 to the cast iron melt prior to casting, simultaneously to casting or as an in-mould inoculant.

22. The method according to claim 21, wherein the particulate ferrosilicon based alloy and the particulate rare earth metal oxide(s), and the particulate $Bi_2O_3$, and/or the particulate $Bi_2S_3$, and/or the particulate $Sb_2O_3$, the particulate $Sb_2S_3$, the one of more of particulate $Fe_3O_4$, $Fe_2O_3$, FeO, or a mixture thereof, and/or the one of more of particulate FeS, $FeS_2$, $Fe_3S_4$, or a mixture thereof, are added as a mechanical mixture or a blend to the cast iron melt.

23. The method according to claim 21, wherein the particulate ferrosilicon based alloy and the particulate rare earth metal oxide(s), and the particulate $Bi_2O_3$, and/or the particulate $Bi_2S_3$, and/or the particulate $Sb_2O_3$, the particulate $Sb_2S_3$, the one of more of particulate $Fe_3O_4$, $Fe_2O_3$, FeO, or a mixture thereof, and/or the one of more of particulate FeS, $FeS_2$, $Fe_3S_4$, or a mixture thereof, are added separately but simultaneously to the cast iron melt.

* * * * *